US008371824B2

(12) United States Patent
Jeong et al.

(10) Patent No.: US 8,371,824 B2
(45) Date of Patent: Feb. 12, 2013

(54) APPARATUS AND METHOD FOR CONTROLLING LINEAR COMPRESSOR WITH INVERTER UNIT

(75) Inventors: Sang-Sub Jeong, Seoul (KR); Jae-Yoo Yoo, Seoul (KR); Jung-Hwan Kang, Seoul (KR); Sung-Ho Park, Seoul (KR); Hyuk Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 778 days.

(21) Appl. No.: 12/314,445

(22) Filed: Dec. 10, 2008

(65) Prior Publication Data

US 2009/0148307 A1 Jun. 11, 2009

(30) Foreign Application Priority Data

Dec. 11, 2007 (KR) ..... 10-2007-0128484

(51) Int. Cl.
*F04B 49/06* (2006.01)

(52) U.S. Cl. ..... 417/44.11; 417/417

(58) Field of Classification Search ..... 417/44.1, 417/44.11, 417
See application file for complete search history.

(56) References Cited

U.S. PATENT DOCUMENTS

2004/0234394 A1* 11/2004 Duncan et al. ..... 417/415
2006/0153688 A1* 7/2006 Lee et al. ..... 417/44.1
2007/0159760 A1* 7/2007 Clark ..... 361/118
2007/0241698 A1* 10/2007 Sung et al. ..... 318/135
2009/0206778 A1* 8/2009 Roh et al. ..... 318/127

FOREIGN PATENT DOCUMENTS

WO WO 2007089083 A2 * 8/2007

* cited by examiner

*Primary Examiner* — Mariceli Santiago
*Assistant Examiner* — Glenn Zimmerman
(74) *Attorney, Agent, or Firm* — McKenna Long & Aldridge LLP

(57) ABSTRACT

An apparatus and method for controlling a linear compressor with an inverter unit. In the apparatus and method, a capacitor is connected between a driving motor and an inverter unit that applies a voltage to the driving motor according to an output frequency thereof, thereby preventing a jump phenomenon due to an inductance of the motor coil. Furthermore, the linear compressor is precisely controlled through the inverter unit, thereby enhancing stability of the apparatus.

14 Claims, 3 Drawing Sheets

APPARATUS AND METHOD FOR CONTROLLING LINEAR COMPRESSOR WITH INVERTER UNIT

RELATED APPLICATION

The present disclosure relates to subject matter contained in priority Korean Application No. 10-2007-0128484, filed on Dec. 11, 2007, which is herein expressly incorporated by reference in its entirety.

BACKGROUND OF THE INVENTION

1. Field of the Invention

The present invention relates to an apparatus and method for controlling a linear compressor with an inverter unit capable of enhancing stability of a system, by preventing a jump phenomenon due to an inductance of a motor coil of a linear compressor, and by precisely controlling the linear compressor through an inverter unit.

2. Background of the Invention

In general, reciprocating compressors serve to suck and compress refrigerant gas to thereafter discharge the compressed refrigerant gas while a piston is linearly reciprocated in a cylinder. Also, the reciprocating compressors are classified, according to a method for operating the piston, into compressors employing a recipro method and compressors employing a linear method.

The reciprocating compressor employing the recipro method is implemented such that a crank shaft is coupled to a rotary motor and a piston is coupled to the crank shaft thus to convert a rotation force of the rotary motor into a reciprocation force. However, the reciprocating compressor employing the linear method is implemented by linearly moving a piston connected to a mover of a linear motor, and thus by reciprocating the piston by a linear motion of the linear motor.

The present invention relates to a reciprocating compressor employing the linear method.

A reciprocating compressor employing the linear method is not provided with a crank shaft for converting a rotating motion into a linear motion, thus not to have a friction loss due to the crank shaft, which results in a higher compression efficiency as compared to that of typical compressors.

In the case that the reciprocating compressor is applied to refrigerators or air conditioners, a voltage is variably applied to a driving motor in the reciprocating compressor. Accordingly, a compression ratio of the reciprocating compressor can also be varied, which enables a control of a freezing capacity of the refrigerators or air conditioners.

The conventional apparatus for controlling a linear compressor includes a current detecting unit for detecting a current applied to a driving motor, a voltage detecting unit for detecting a voltage applied to the driving motor, a stroke calculating unit for calculating a stroke estimation value of the compressor based upon the detected current and voltage of the driving motor, a control unit for generating a frequency input control signal, and an inverter unit for varying a voltage applied to the driving motor by changing a driving frequency based on the frequency input control signal generated by the control unit.

The voltage detecting unit detects a voltage applied to the driving motor, and the current detecting unit detects a current applied to the driving motor. And, the stroke calculating unit calculates a stroke estimation value based on the voltage and current applied to the driving motor. The control unit changes a frequency of the driving motor based on a load within a preset range, thereby adjust the frequency with a mechanic resonation of a mechanic part. Then, the control unit applies a voltage and a current to the driving motor.

The conventional apparatus for controlling a linear compressor with an inverter unit has the following problems.

Firstly, a stroke, a gas spring, etc. are calculated based on a voltage and a current detected by the voltage detecting unit and the current detecting unit. In this case, may occur a jump phenomenon that two or more strokes are generated at the same voltage due to an inductance of a coil of the driving motor.

Secondly, the jump phenomenon causes the linear compressor to have a lowered capacity varying characteristic and controlling characteristic of the linear compressor, and the apparatus to have a degraded stability.

SUMMARY OF THE INVENTION

Therefore, an object of the present invention is to provide an apparatus and method for controlling a linear compressor with an inverter unit capable of easily controlling a linear compressor and enhancing stability of a system, by preventing a jump phenomenon due to an inductance of a motor coil of the linear compressor, and by minimizing a voltage lowering.

Another object of the present invention is to provide an apparatus and method for controlling a linear compressor with an inverter unit capable of easily controlling a linear compressor and enhancing stability, by preventing a jump phenomenon due to an inductance of a motor coil of the linear compressor resulting from changes of an output frequency of the inverter unit, and by minimizing a voltage lowering.

Still another object of the present invention is to provide an apparatus and method for controlling a linear compressor with an inverter unit capable of easily controlling a linear compressor and enhancing stability, by preventing a jump phenomenon due to an inductance of a motor coil changed according to a load of the linear compressor, and by minimizing a voltage lowering.

To achieve these and other advantages and in accordance with the purpose of the present invention, as embodied and broadly described herein, there is provided an apparatus for controlling a linear compressor with an inverter unit, comprising: an inverter unit for inverting an input power into a driving power to be supplied to a driving motor; and one or more capacitors for attenuating an inductance of a coil wound on the driving motor according to an output frequency of the inverter unit.

The one or more capacitors are connected in series between the inverter unit and the driving motor.

The apparatus further comprise a current detecting unit for detecting a current applied to the driving motor, a voltage detecting unit for detecting a voltage applied to the driving motor; a stroke calculating unit for calculating a stroke estimation value based on the detected current and voltage; and a control unit for changing an output frequency of the inverter unit.

To achieve these and other advantages and in accordance with the purpose of the present invention, as embodied and broadly described herein, there is also provided a method for controlling a linear compressor with an inverter unit, comprising: changing an output frequency of an inverter unit that applies an AC power to a driving motor of a linear compressor; and determining a capacitance that attenuates an inductance of the driving motor based on the changed output frequency.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

IN THE DRAWINGS

Figure 1:
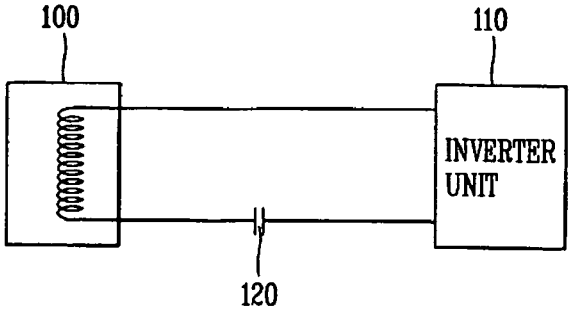
Figure 2:
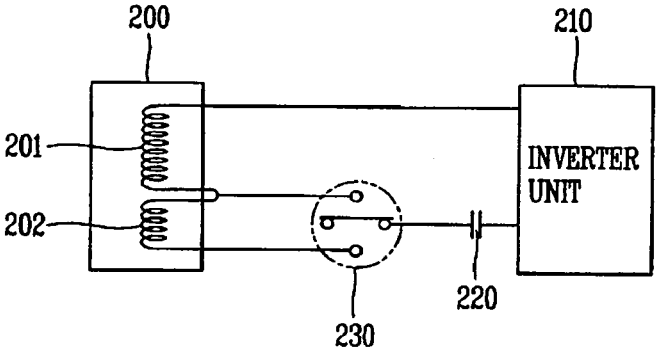
Figure 3:
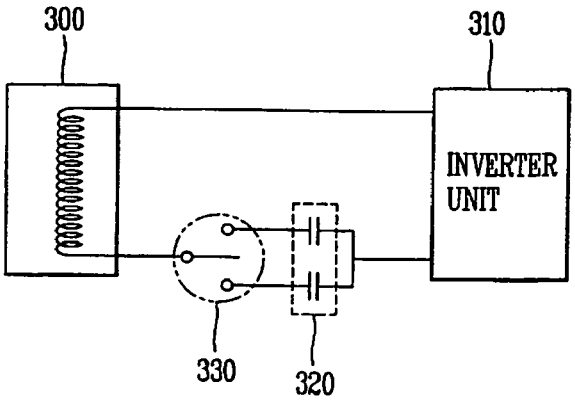
Figure 4:
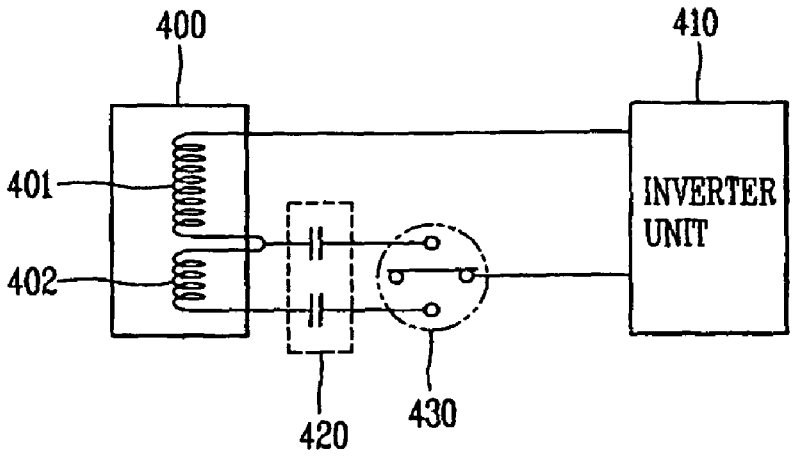
Figure 5:
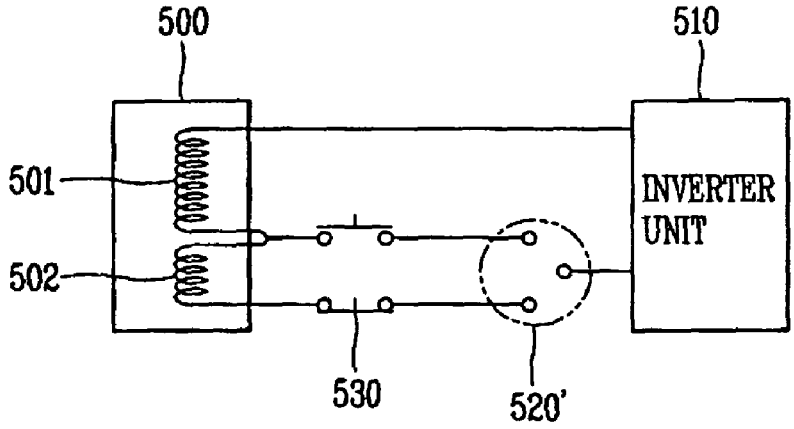
Figure 6:
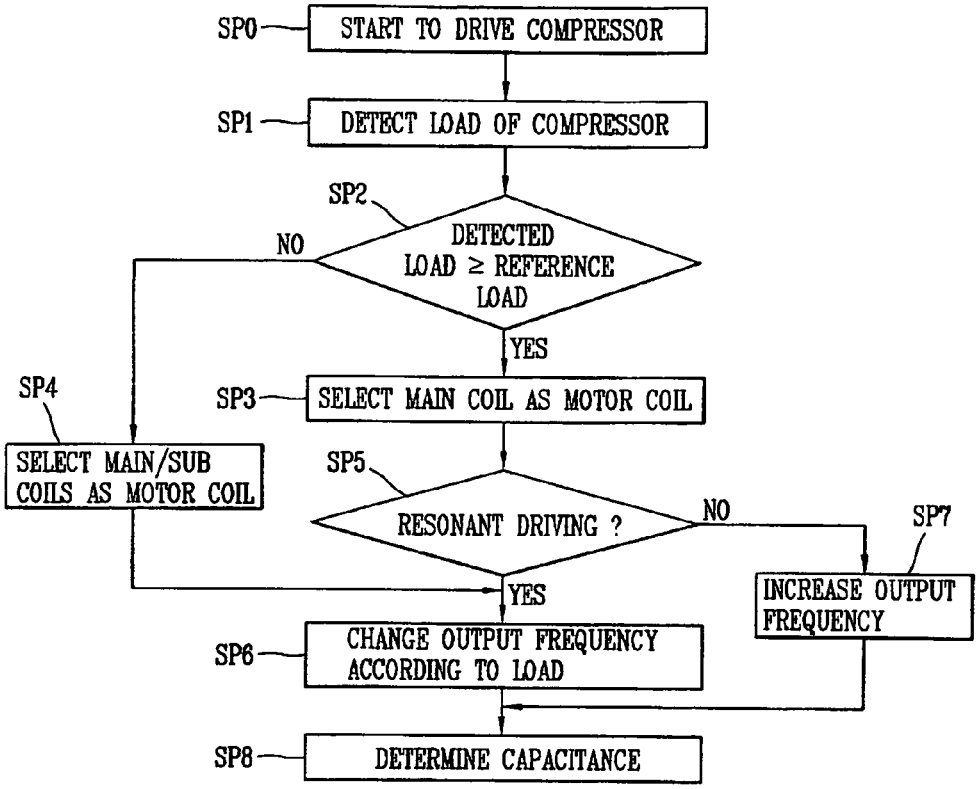

FIG. 1 is a diagram showing an apparatus for controlling a linear compressor with an inverter unit according to a first embodiment of the present invention;

FIG. 2 is a diagram showing an apparatus for controlling a linear compressor with an inverter unit according to a second embodiment of the present invention;

FIG. 3 is a diagram showing an apparatus for controlling a linear compressor with an inverter unit according to a third embodiment of the present invention;

FIG. 4 is a diagram showing an apparatus for controlling a linear compressor with an inverter unit having two capacitors according to a fourth embodiment of the present invention;

FIG. 5 is a diagram showing an apparatus for controlling a linear compressor with an inverter unit having a multi-capacitor according to a fourth embodiment of the present invention; and FIG. 6 is a flowchart schematically showing a method for controlling a linear compressor with an inverter unit according to the present invention.

DETAILED DESCRIPTION OF THE INVENTION

Description will now be given in detail of the present invention, with reference to the accompanying drawings.

Hereinafter, will be explained an apparatus and method for controlling a linear compressor with an inverter unit.

FIGS. 1 to 5 are diagrams schematically showing an apparatus for controlling a linear compressor with an inverter unit according to the present invention, and FIG. 6 is a flowchart schematically showing a method for controlling a linear compressor with an inverter unit according to the present invention.

As shown in FIG. 1, an apparatus for controlling a linear compressor with an inverter unit according to a first embodiment of the present invention comprises an inverter unit 110 for applying an AC power to a driving motor 100, and one or more capacitors 120 for attenuating an inductance of a coil wound on the driving motor 100 according to an output frequency of the inverter unit 110. The one or more capacitors 120 are connected in series between the inverter unit 110 and the driving motor 100.

The linear compressor and the driving motor are operated by an inverter unit. The inverter unit changes its output frequency within a prescribed range so as to implement a mechanic resonant frequency. The one or more capacitors 120 respectively have a different capacitance so as to attenuate an inductance of the motor coil according to the changed output frequency.

Hereinafter, with reference to the following formulas 2, will be explained a linear compressor having one capacitor between the driving motor and the inverter unit.

A voltage applied to the driving motor and two ends of the capacitor will be expressed as the following formula 1.

$$V_{in} = L\frac{di}{dt} + \frac{1}{C}\int i\,dt + Ri + \alpha\vec{x} \qquad \text{[Formula 1]}$$

Here, the 'Vin' indicates a voltage applied to the driving motor, the 'α' indicates a motor constant for converting an electric force into a mechanic force, the 'x' indicates a stroke, the 'R' indicates an inner resistance of the driving motor, and the 'L' indicates an inductance of the motor coil. And, the 'C' indicates a capacitance of a capacitor connected between the driving motor and the inverter unit, which may be expressed as the following formula 2.

$$C = \frac{1}{(2\pi f)^2 L} \qquad \text{[Formula 2]}$$

Here, the 'f' indicates a driving frequency, i.e., an output frequency of the inverter unit.

The capacitance (C) is preset according to the output frequency of the inverter unit, and is resonated with the inductance (L) according to the output frequency. More concretely, as the capacitance (C) and the inductance (L) are resonated with each other to be attenuated, the voltage (Vin) applied to the driving motor may be expressed as the following formula 3.

$$V_{in} = Ri + \alpha\vec{x} \qquad \text{[Formula 3]}$$

A voltage due to the resistance is relatively low, and a voltage due to the inductance and a voltage due to the capacitance are attenuated. This causes the voltage (Vin) to have a similar value to a counter electromotive force ($\alpha\vec{x}$).

Accordingly, a voltage lowering due to the inductance (L) can be lowered, and the lower voltage (Vin) can serve to generate a necessary stroke.

As shown in FIG. 2, an apparatus for controlling a linear compressor with an inverter unit according to a second embodiment of the present invention comprises an inverter unit 210 for applying an AC power to a driving motor 200; one or more capacitors 220 connected in series between the inverter unit 210 and the driving motor 200, for attenuating an inductance of a coil wound on the driving motor 200 according to an output frequency of the inverter unit 210; a control unit (not shown) for selecting a main coil 201 or main/sub coils 201/202 as the motor coil according to a load of the linear compressor; and a second switching unit 230 operated by the control unit, for connecting the sub coil 202 to the main coil 201.

When a load of the linear compressor is more than a preset value, the control unit disconnects the main coil and the sub coil from each other. On the contrary, when a load of the linear compressor is less than a preset value, the control unit connects the main coil and the sub coil to each other.

As the second switching unit 230, a relay may be used. The capacitor 220 may be connected between the end of the main coil and the second switching unit 230, between the end of the sub coil and the second switching unit 230, and between the second switching unit 230 and the inverter unit. Here, the capacitor 220 may be integrally connected therebetween.

In the present invention, an inductance of the motor coil and a capacitance of the capacitor are preset according to a load of the linear compressor, and are connected to each other to be resonated, which enables a stable driving of the system.

As shown in FIG. 3, an apparatus for controlling a linear compressor with an inverter unit according to a third embodiment of the present invention comprises an inverter unit 310 for applying an AC power to a driving motor 300; one or more capacitors 320 connected in series between the inverter unit 310 and the driving motor 300, for attenuating an inductance of a coil wound on the driving motor 300 according to an output frequency of the inverter unit 310; and a first switching unit 330 for selecting one or more of the capacitors 320 according to the output frequency of the inverter unit 310. The apparatus for controlling a linear compressor with an inverter unit further comprises a control unit (not shown) for controlling an output frequency of the inverter unit, and driving the first switching unit according to the output frequency.

The control unit controls the output frequency of the inverter unit according to a load of the linear compressor. When the linear compressor has a load more than a preset value, the control unit increases the output frequency of the inverter unit to a value larger than a resonant frequency.

As the first switching unit 330, a relay may be used. The one or more capacitors are connected between the driving motor and the inverter unit, and are respectively set to have a different capacitance (C) according to a changed output frequency.

The linear compressor has a resonant frequency varied due to a gas spring according to a load. For maximum efficiency of the linear compressor, the resonant frequency is controlled by the inverter unit. Here, the output frequency of the inverter unit is within various ranges. Accordingly, as a plurality of capacitors are connected to the driving motor in series by the first switching unit 330, a jump phenomenon due to an inductance of the motor coil is minimized.

When the linear compressor has a load more than a preset value, the control unit recognizes the load as an overload. In this case, it is more important to obtain a freezing capacity than to perform a resonant driving. This causes the linear compressor to be operated in a state that an output frequency is higher than a resonant frequency. In the case of an overload, performed is a driving for obtaining a compression volume by offsetting a piston by applying a current offset voltage to a voltage to be applied to the driving motor so as to obtain a freezing capacity. In the case of the driving employing an output frequency higher than a resonant frequency, i.e., an over frequency, the system may be unstably operated. In order to minimize the unstable operation, one or more capacitors are respectively connected between the driving motor and the inverter unit so as to have a different capacitance according to the output frequency.

Referring to FIG. 4, an apparatus for controlling a linear compressor with an inverter unit according to a fourth embodiment of the present invention comprises an inverter unit 410 for applying an AC power to a driving motor 400; one or more capacitors 420 connected in series between the inverter unit 410 and the driving motor 400, for attenuating an inductance of a coil wound on the driving motor 400 according to an output frequency of the inverter unit 410; a control unit (not shown) for selecting a main coil 401 or main/sub coils 401/402 as the motor coil according to a load of the linear compressor; and a second switching unit 430 operated by the control unit, for connecting the sub coil 402 to the main coil 401. When a load of the linear compressor is more than a preset value, the control unit disconnects the main coil and the sub coil from each other. On the contrary, when a load of the linear compressor is less than a preset value, the control unit connects the main coil 401 and the sub coil 402 to each other.

As the one or more capacitors 420, capacitors each having a different capacitance may be implemented so as to attenuate an inductance of the motor coil selected according to a load of the linear compressor. The second switching unit 430 connects or disconnects the sub coil to/from the main coil, and selects a capacitor that attenuates an inductance of the motor coil.

The one or more capacitors may be implemented as a multi-capacitor having two or more capacitance. Referring to FIG. 5, an apparatus for controlling a linear compressor with an inverter unit according to a fourth embodiment of the present invention comprises a multi-capacitor 520', and an interworking switch 530 for selecting one of capacitance of the multi-capacitor based on a control signal by the control unit. The multi-capacitor 520 and the interworking switch 530 may be connected to the inverter unit and the driving motor having a main coil 501 and a sub coil 502.

Referring to FIGS. 1 to 5, the apparatus for controlling a linear compressor with an inverter unit according to the present invention adopts two capacitors. However, three or more capacitors may be adopted.

Referring to FIG. 6, a method for controlling a linear compressor with an inverter unit comprises changing an output frequency of an inverter unit that applies an AC power to a driving motor of the linear compressor (SP6, SP7), and determining a capacitance that attenuates an inductance of the driving motor based on the changed output frequency (SP8). The step for determining a capacitance (SP8) may include determining a capacitance that attenuates an inductance of the motor coil according to the output frequency, connecting one or more capacitors having the determined capacitance to the driving motor, respectively, and selecting one of the capacitors connected to the driving motor.

The method for controlling a linear compressor with an inverter unit may further comprise detecting a load of the linear compressor (SP1). The control unit changes an output frequency of the inverter unit according to the detected load. Here, when the detected load is more than a preset value, the control unit increases the output frequency of the inverter unit (SP7).

The method for controlling a linear compressor with an inverter unit may further comprise changing an inductance of the driving motor based on the detected load (SP2, SP3 and SP4).

Firstly, a reference load is preset, and then the linear compressor is operated (SP0). Then, a load of the linear compressor is detected, and is compared with the preset reference load (SP1, SP2). When the detected load of the linear compressor is more than the preset reference load, the control unit recognizes the detected load as an overload. Accordingly, the control unit disconnects the main and sub coils from each other, and drives the linear compressor by selecting the main coil as a motor coil. On the other hand, when the detected load of the linear compressor is less than the preset reference load, the control unit recognizes the detected load as a normal load. Accordingly, the control unit connects the main coil and the sub coil to each other, and drives the linear compressor by selecting the main and sub coils as a motor coil.

In the case of an overload, it is determined whether to continue to perform a resonant driving, or to perform a driving to obtain a freezing capacity (SP5). If it is determined to continue to perform a resonant driving, an output frequency of the inverter unit is changed according to a load of the linear compressor. On the contrary, if it is determined to obtain a freezing capacity, the linear compressor is operated by increasing an output frequency of the inverter unit. A capacitance is set based on the output frequency and the inductance, and a degraded stability of the system due to the inductance is minimized.

In the apparatus and method for controlling a linear compressor with an inverter unit according to the present invention, one capacitor having a different capacitance is selected according to an output frequency of the inverter unit. This prevents an unstable operation of the system, such as a jump phenomenon due to an inductance of the motor coil of the linear compressor, and allows the linear compressor to be precisely controlled through the inverter unit.

In the apparatus and method for controlling a linear compressor with an inverter unit according to the present invention, a load of the linear compressor is detected, an inductance is determined based on the detected load, and a capacitance is set based on an output frequency of the inverter unit according to the inductance and the load. This prevents an unstable operation of the system, such as a jump phenomenon due to an inductance of the motor coil of the linear compressor, and allows the linear compressor to be precisely controlled through the inverter unit.

In the apparatus and method for controlling a linear compressor with an inverter unit according to the present invention, when a freezing capacity is obtained by increasing an output frequency of the inverter unit in the case of an overload, a capacitance is set in correspondence to the output frequency. This prevents an unstable operation of the system, such as a jump phenomenon due to an inductance of the motor coil of the linear compressor, and enhances stability of the entire system.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An apparatus for controlling a linear compressor with an inverter unit, comprising:

an inverter unit for inverting an input power into a driving power to be supplied to a driving motor;

one capacitor, or two or more capacitors connected in series, connected between the inverter unit and the driving motor for attenuating a voltage lowering due to an inductance of a coil wound on the driving motor according to an output frequency of the inverter unit;

a first switching unit for selecting the one capacitor or selecting a part or all of two or more capacitors according to an output frequency of the inverter unit; and a control unit for controlling the output frequency of the inverter unit, and driving the first switching unit according to the output frequency.

2. The apparatus of claim 1, wherein the control unit controls the output frequency of the inverter unit according to a load of the linear compressor.

3. The apparatus of claim 2, wherein when a load of the linear compressor is more than a preset value, the control unit increases the output frequency of the inverter unit.

4. The apparatus of claim 1, wherein the motor coil is classified into a main coil and a sub coil.

5. The apparatus of claim 4, wherein the control unit controls the motor coil to serve as the main coil or the main/sub coils according to a load of the linear compressor.

6. The apparatus of claim 5, wherein when a load of the linear compressor is more than a preset value, the control unit disconnects the main coil and the sub coil from each other, and when a load of the linear compressor is less than a preset value, the control unit connects the main coil and the sub coil to each other.

7. The apparatus of claim 6, further comprising a second switching unit operated by the control unit, for connecting or disconnecting the sub coil to/from the main coil.

8. The apparatus of claim 7, wherein two or more capacitors are implemented as a plurality of capacitors connected to each other in parallel, and each of the capacitors has a different capacitance.

9. The apparatus of claim 8, wherein the control unit determines an inductance of the motor coil by driving the second switching unit based on a load of the linear compressor, and selects one of the plurality of capacitors that attenuates a voltage lowering due to the determined inductance by driving the first switching unit.

10. The apparatus of claim 7, wherein the one or more capacitors are implemented as a multi-capacitor having two or more capacitance.

11. A method for controlling a linear compressor with an inverter unit, comprising:

detecting a load of the linear compressor;

changing an output frequency of an inverter unit that applies a driving power to a driving motor of a linear compressor according to the detected load; and determining a capacitance that attenuates a voltage lowering due to an inductance of the driving motor based on the changed output frequency, wherein in the step of changing an output frequency of an inverter unit, when the detected load is more than a preset value, determining whether to continue to perform resonant driving or to obtain a freezing capacity.

12. The method of claim 11, wherein in the step of changing an output frequency of an inverter unit, an output frequency of an inverter unit is changed according to the detected load.

13. The method of claim 11, wherein in the step of changing an output frequency of an inverter unit, when the detected load is more than a preset value, an output frequency of an inverter unit is increased.

14. The method of claim 11, further comprising changing an inductance of the driving motor according to the detected load.

* * * * *